US007387532B1

(12) United States Patent
Mao

(10) Patent No.: US 7,387,532 B1
(45) Date of Patent: Jun. 17, 2008

(54) POWER CONNECTOR

(75) Inventor: Hu-Qing Mao, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/742,494

(22) Filed: Apr. 30, 2007

(51) Int. Cl.
*H01R 9/05* (2006.01)

(52) U.S. Cl. ..... 439/578; 439/63; 439/263; 439/851

(58) Field of Classification Search ..... 439/63, 439/263, 311, 578, 675, 843, 851, 852
See application file for complete search history.

(56) References Cited

U.S. PATENT DOCUMENTS 2,628,855 A * 2/1953 Cushman ..... 403/152
3,957,331 A * 5/1976 Tantillo et al. ..... 439/20
4,003,616 A * 1/1977 Springer ..... 439/23
4,402,114 A * 9/1983 Takagi ..... 24/579.11
5,566,432 A * 10/1996 Perisho et al. ..... 24/703.1
6,343,963 B1 * 2/2002 Bronk ..... 439/805
7,108,514 B2 9/2006 Chen et al.

* cited by examiner

*Primary Examiner*—James Harvey
(74) *Attorney, Agent, or Firm*—Birch, Stewart, Kolasch & Birch, LLP

(57) ABSTRACT

A power connector includes a main body and a conductive contact. The main body has a front surface and a sidewall. The front surface defines a receiving cavity. The front of the sidewall defines a groove communicating with the receiving cavity at the top, then a propping beam is formed at the front of the groove. The propping beam defines a gap communicating with the receiving cavity. The gap communicates with the groove at back and communicates with the outside at front. The conductive contact is received in the receiving cavity of the main body, having a fixing portion, a base portion and connecting portions connecting the fixing and base portions. The fixing portion is formed an arch structure, then an opening end is formed at the top. A propping portion is projected from the fixing portion. The propping portion is secured in the groove by against the propping beam. Therefore, the conductive contact can be fastened firmly and securely.

6 Claims, 3 Drawing Sheets

POWER CONNECTOR

BACKGROUND OF THE INVENTION

1. Field of the Invention

The present invention relates to a power connector, and more particularly to a power connector with a conductive contact fastened firmly and securely.

2. The Related Art

Power connectors are widely used in the field of electronics. A conventional power connector comprises a main body and a conductive contact received in the main body. In order to transmit an electrical signal steadily, it's necessary to ensure a certain pressing force between the conductive contact and a terminal of a mating power connector while the mating power connector is engaging with the conductive contact. Because of the pressing force, a pushing/pulling force between the conductive contact and the terminal of the mating connector arises when the mating connector is inserted into or drawn out of the power connector, and the pushing/pulling force will make the conductive contact move forwards or backwards and affect the secure retention of the conductive contact in the main body of the power connector, and then affect the transmission of the electrical signal.

U.S. Pat. No. 7,108,514 discloses a conductive contact with a housing fixed at the front of a main body, to prevent the conductive contact from moving forwards or backwards. However, by this way, it must add another components. With the increase of the number of the components, the problems will increase too, for example, the housing looses from the main body, and then causes the unstable engagement between the conductive contact and the main body, therefore, the electrical signal is unsteadily transmitted.

SUMMARY OF THE INVENTION

An object of the present invention is to provide a power connector with a conductive contact fastened firmly and securely. The power connector comprises a main body and the conductive contact received in the main body. The main body has a front surface, a back surface and a sidewall. The front surface defines a receiving cavity. The front of the sidewall defines a groove communicating with the receiving cavity at the top, then a propping beam is formed at the front of the groove. The propping beam defines a gap communicating with the receiving cavity. The gap communicates with the groove at back and communicates with the outside at front. The conductive contact is received in the receiving cavity of the main body, having a fixing portion, a base portion and connecting portions connecting the fixing and base portions. The fixing portion is formed an arch structure, then an opening end is formed at the top. A propping portion is projected from the fixing portion. The propping portion is secured in the groove by against the propping beam.

As described above, the propping portions of the conductive contact is secured in the groove by against the propping beam, which prevents the conductive contact from rotating and moving in the main body, and ensures the conductive contact being fastened firmly and securely. Therefore, the affection of a pushing/pulling force between the conductive contact and a terminal of a mating connector on the secure retention of the conductive contact in the main body is decreased or even eliminated. Thereby, a steady transmission of the electrical signal is achieved.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
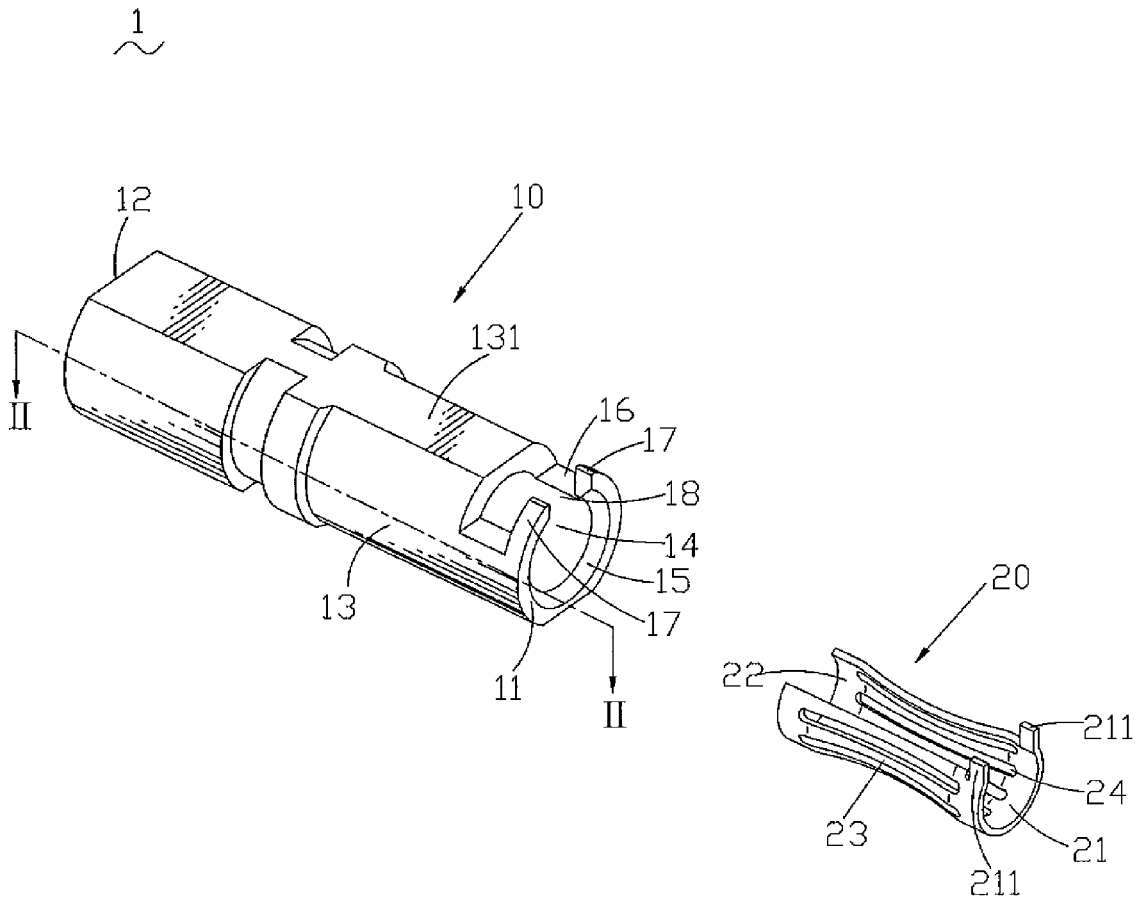
FIG. 1 is an exploded view of a power connector according to the present invention.
Figure 2:
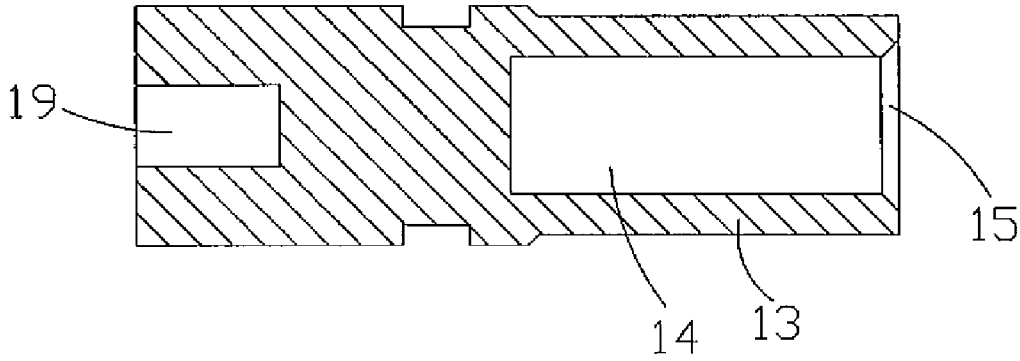
FIG. 2 is a cross-sectional view of a main body in FIG. 1 taken along line II-II.

With reference to FIG. 1 and FIG. 2, a power connector 1 of the present invention comprises a main body 10 and a conductive contact 20 received in the main body 10. The main body 10 is about cylinder-shaped, having a front surface 11, a back surface 12 and a sidewall 13. A receiving cavity 14 is opened in the main body 10 from the front surface 11 to the middle part of the main body 10. There is a guiding portion 15 defined at the front of the receiving cavity 14. The guiding portion 15 is a trumpet shape and connects with the front surface 11. Two parallel positioning surfaces 131 are defined at the top and the bottom of the sidewall 13. A groove 16 is defined vertically to the positioning surface 131 in the front of the positioning surface 131. The groove 16 communicates with the receiving cavity 14 at the top, and is shallow than the middle of the receiving cavity 14, then a propping beam 17 is formed at the front of the groove 16. A gap 18 is opened in the middle part of the propping beam 17. The gap 18 is also defined in and vertically to the positioning surface 131. The gap 18 communicates with the receiving cavity 14. The place where the gap 18 communicates with the receiving cavity 14 is over the place where the groove 16 communicates with the receiving cavity 14. The gap 18 communicates with the groove 16 at back and communicates with the outside at front. The gap 18 defines two laterals extending upright. A connecting cavity 19 is defined in the back surface 12 of the main body 10, and the connecting cavity 19 doesn't communicate with the receiving cavity 14. A wire (not shown) is received in the connecting cavity 19.

Referring to FIG. 1 again, the conductive contact 20 is about a cage shape and has a fixing portion 21, a base portion 22 and connecting portions 23 connecting the fixing and base portions 21, 22. The fixing portion 21 is formed by a rectangular board bending to form an arch structure, then an opening end 24 is formed. Two propping portions 211 are projected from the ends of the fixing portion 21. The base portion 22 is also formed by rectangular board bending to form an arch structure. The connecting portions 23 extend lengthwise and connect the corresponding places of the fixing and base portions 21, 23. The connecting portions 23 are arranged equidistantly. The middle portion of the connecting portion 23 bends inwards and forms an arc shape.

Figure 3:
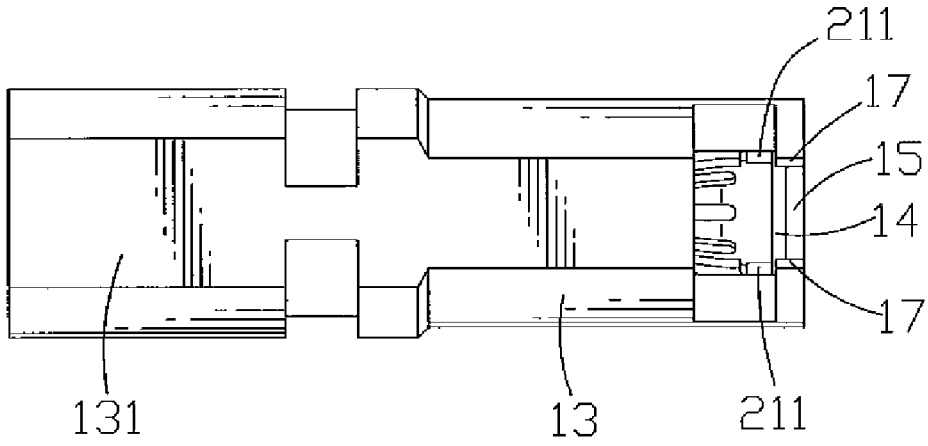
FIG. 3 is a plan view of the power connector of the present invention.
Figure 4:
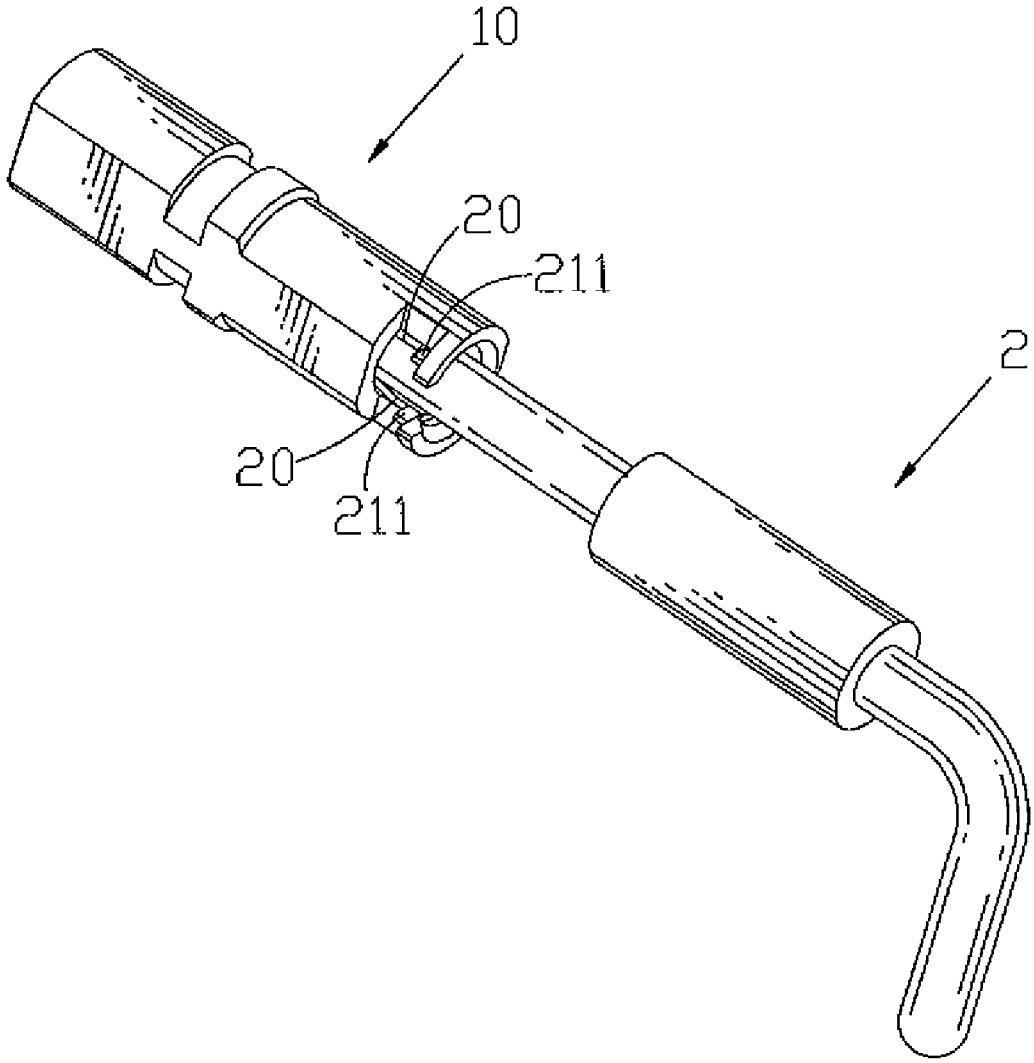
FIG. 4 is a perspective view of the power connector engaging with a terminal of a mating power connector.

Referring to FIG. 3 and FIG. 4, the conductive contact 20 is inserted in the receiving cavity 14 along the guiding portion 15, and the propping portions 211 of the fixing portion 21 are compressed inwards, then enter the groove 16 along the gap 18. The propping portions 211 are secured in the groove 16 by against the propping beam 17 respectively. Therefore, the conductive contact 20 cannot rotate or move in the main body

10. When a terminal 2 of a mating power connector is inserted into the conductive contact 20, a transmission of the electrical signal is achieved.

As described above, the propping portions 211 of the conductive contact 20 are secured in the groove 16 and by against the propping beam 17. Therefore, the conductive contact 20 is fastened firmly and securely in the main body 10, and the conductive contact 20 cannot rotate or move in the main body 10 when the terminal 2 of the mating power connector is inserted or drawn out. Thereby, a steady transmission of the electrical signal is achieved.

What is claimed is:

1. A power connector comprising:

a main body, a top a front surface, a back surface and a sidewall, the front surface defining a receiving cavity, the front of the sidewall defining a groove communicating with the receiving cavity at the top, a propping beam being formed at the front of the groove, the propping beam defining a gap communicating with the receiving cavity, the gap communicating with the groove at a back and communicating with the outside at the front surface; and a conductive contact received in the receiving cavity of the main body, having a fixing portion, a base portion and connecting portions connecting the fixing and base portions, the fixing portion being formed as an arch structure, an opening end being formed at the top, two propping portions projected from the fixing portion, wherein the propping portions are secured in the groove against the propping beam.

2. The power connector as claimed in claim 1, wherein the groove is shallow than the middle of the receiving cavity, the place where the gap communicates with the receiving cavity is over the place where the groove communicates with the receiving cavity.

3. The power connector as claimed in claim 2, wherein the gap defines two laterals extending upright, the propping portions are projected from the ends of the fixing portion.

4. The power connector as claimed in claim 1, wherein the back surface of the main body defines a connecting cavity for receiving a wire, the connecting cavity do not communicates with the receiving cavity.

5. The power connector as claimed in claim 1, wherein the main body is substantially cylinder-shaped, the sidewall of the main body defines two parallel positioning surfaces, the groove and the gap are opened vertically to one of the positioning surfaces.

6. The power connector as claimed in claim 1, wherein the base portion is formed as an arch structure, the connecting portions extend lengthwise and connect to corresponding places of the fixing and base portions, a middle portion of each the connecting portions bends inwards and forms an arc shape.

* * * * *